US012529540B2

(12) United States Patent
Riley

(10) Patent No.: US 12,529,540 B2
(45) Date of Patent: Jan. 20, 2026

(54) SUPPRESSOR MOUNT FACILITY FOR A FIREARM

(71) Applicant: HiPerformance LLC, New Century, KS (US)

(72) Inventor: Bradford Whittam Riley, Paola, KS (US)

( * ) Notice: Subject to any disclaimer, the term of this patent is extended or adjusted under 35 U.S.C. 154(b) by 0 days.

(21) Appl. No.: 18/586,467

(22) Filed: Feb. 24, 2024

(65) Prior Publication Data

US 2024/0288243 A1 Aug. 29, 2024

Related U.S. Application Data

(60) Provisional application No. 63/448,037, filed on Feb. 24, 2023.

(51) Int. Cl.
*F41A 21/32* (2006.01)

(52) U.S. Cl.
CPC ..... *F41A 21/325* (2013.01)

(58) Field of Classification Search
CPC ..... F41A 21/325; F41A 21/32; F41A 21/34; F41A 21/36; F41A 21/38; F41A 21/40; F41A 21/42
See application file for complete search history.

(56) References Cited

U.S. PATENT DOCUMENTS

| | | | | |
|---|---|---|---|---|
| 4,510,843 | A * | 4/1985 | Rabatin | F41A 21/325 89/14.4 |
| 9,500,427 | B1 * | 11/2016 | Larue | F41A 21/30 |
| 9,709,354 | B2 * | 7/2017 | Larue | F41A 21/34 |
| 10,082,355 | B2 * | 9/2018 | Addis | F41A 21/36 |
| 11,262,150 | B1 * | 3/2022 | VanFossan | F41A 21/36 |
| 2014/0237881 | A1 * | 8/2014 | Mack | F41A 21/325 42/90 |
| 2018/0017352 | A1 * | 1/2018 | Addis | F41A 21/36 |
| 2018/0038663 | A1 * | 2/2018 | Larue | F41A 21/30 |
| 2018/0058791 | A1 * | 3/2018 | Larue | F41A 21/325 |
| 2021/0356225 | A1 * | 11/2021 | Kras | F41A 21/325 |

FOREIGN PATENT DOCUMENTS

| | | | | |
|---|---|---|---|---|
| WO | WO-2017034715 A1 * | 3/2017 | | F16L 19/005 |
| WO | WO-2020041505 A1 * | 2/2020 | | F41A 21/325 |

* cited by examiner

*Primary Examiner* — Jonathan C Weber
(74) *Attorney, Agent, or Firm* — Dale J. Ream

(57) ABSTRACT

A suppressor mount facility for a firearm has a rear cap associated with a suppressor, an adapter having a facility for connection to a barrel associated with the firearm and defining an adapter bore, the rear cap defining an internally threaded cap bore, the adapter having an externally threaded portion configured to removably connect to the internally threaded cap bore in a connected condition, and at least one of the rear cap and the adapter having a flexible spring portion configured to bias against the other of the rear cap and the adapter when in the connected condition. There may be a plurality of springs arranged circumferentially about the adapter bore. The plurality of springs may be leaf springs. The plurality of springs may extend rearwardly from the threaded portion of the adapter.

16 Claims, 14 Drawing Sheets

SUPPRESSOR MOUNT FACILITY FOR A FIREARM

CROSS-REFERENCE TO RELATED APPLICATION

This application claims the benefit of U.S. Provisional Patent Application No. 63/448,037 filed on Feb. 24, 2023, entitled "TENSION MOUNT FOR MUZZLE DEVICES," which is hereby incorporated by reference in its entirety for all that is taught and disclosed therein.

FIELD OF THE INVENTION

The present invention relates to firearms, and more particularly to a suppressor mount facility for a firearm that enables rapid attachment and detachment of a suppressor to a firearm barrel.

BACKGROUND AND SUMMARY OF THE INVENTION

Quick Detach (QD) mounts for suppressors and other muzzle devices are very popular in the civilian market and even required by certain military units. A variety of QD mounts exist, but they suffer from various challenges. When a muzzle device is attached to a firearm barrel, heat cycles and vibrations can cause the device to loosen over time. Securely attaching the device by using high torque or thread locker compound is undesirable because both prevent easy removal. Prior art QD mounts often involve small, delicate springs, latches, and other components that can experience carbon lock or fail to withstand numerous heat cycles and vibrations. Prior art QD mounts also frequently add excessive weight, length, complexity, and cost while still being somewhat time consuming to install and remove.

Using a combination of small springs, latches and tapers is problematic for the following reasons:

- High heat quickly affects spring tension.
- A dirty high carbon environment causes premature failure of springs and latches.
- Small delicate springs and latches are subject to external abuse and failure.
- Tapers can and do work loose, allowing the muzzle device/suppressor to back off. This can result in the muzzle device/suppressor drooping into the path of a projectile, resulting in a dangerous and damaging situation.
- Added bulk, weight and length are undesirable.
- Manufacturing of small delicate parts adds unnecessary cost.

Therefore, a need exists for a new and improved suppressor mount facility for a firearm that enables rapid attachment and detachment of a suppressor to a firearm barrel. In this regard, the various embodiments of the present invention substantially fulfill at least some of these needs. In this respect, the suppressor mount facility for a firearm according to the present invention substantially departs from the conventional concepts and designs of the prior art, and in doing so provides an apparatus primarily developed for the purpose of enabling rapid attachment and detachment of a suppressor to a firearm barrel.

The present invention provides an improved suppressor mount facility for a firearm, and overcomes the above-mentioned disadvantages and drawbacks of the prior art. As such, the general purpose of the present invention, which will be described subsequently in greater detail, is to provide an improved suppressor mount facility for a firearm that has all the advantages of the prior art mentioned above.

To attain this, the preferred embodiment of the present invention essentially comprises a rear cap associated with a suppressor, an adapter having a facility for connection to a barrel associated with the firearm and defining an adapter bore, the rear cap defining an internally threaded cap bore, the adapter having an externally threaded portion configured to removably connect to the internally threaded cap bore in a connected condition, and at least one of the rear cap and the adapter having a flexible spring portion configured to bias against the other of the rear cap and the adapter when in the connected condition. There may be a plurality of springs arranged circumferentially about the adapter bore. The plurality of springs may be leaf springs. The plurality of springs may extend rearwardly from the threaded portion of the adapter. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
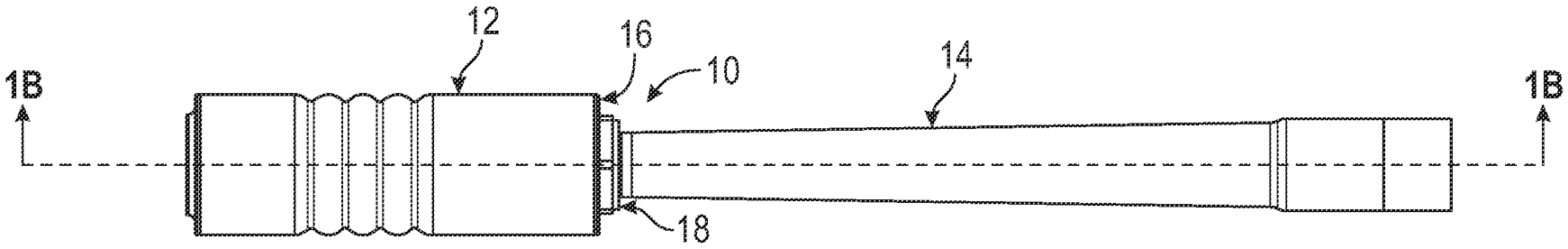
FIG. 1A is a side view of the current embodiment of a suppressor mount facility for a firearm constructed in accordance with the principles of the present invention in use attaching a suppressor to the barrel associated with a host firearm.
Figure 1B:
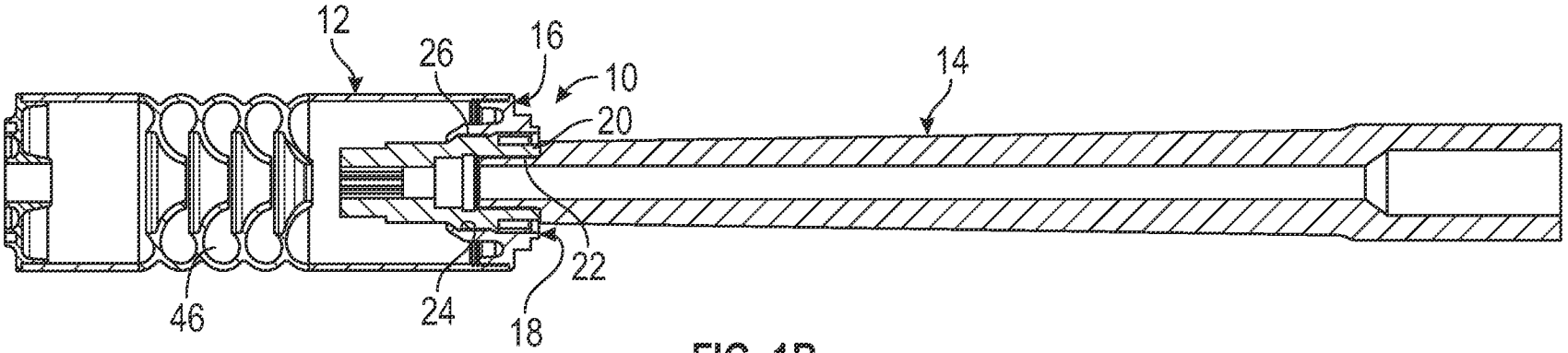
FIG. 1B is a side sectional view taken along line 1B-1B of FIG. 1A.
Figure 2A:
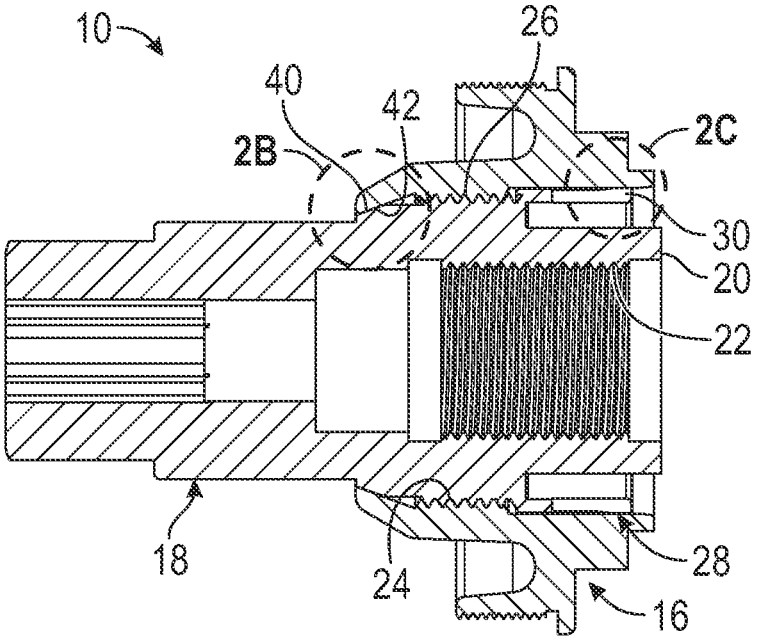
FIG. 2A is side sectional view of the suppressor mount facility for a firearm of FIG. 1 in the assembled condition.
Figure 2B:
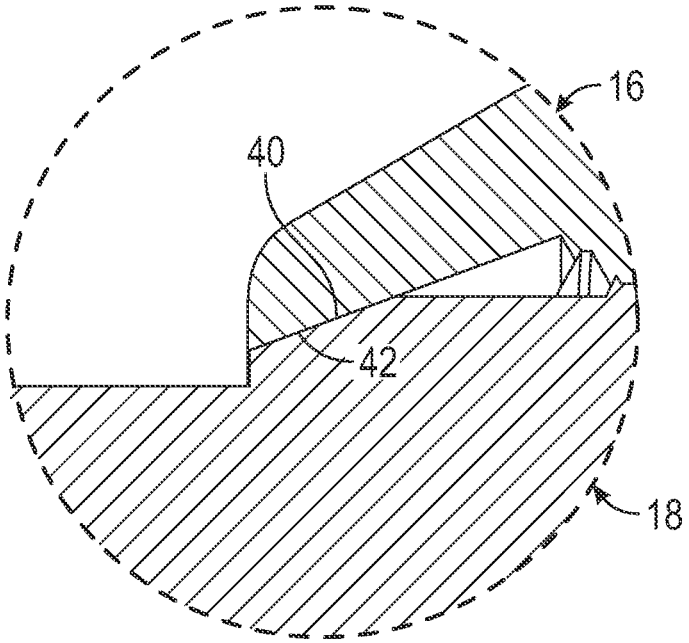
FIG. 2B is an enlarged partial view taken along circle 2B of FIG. 2A.
Figure 2C:
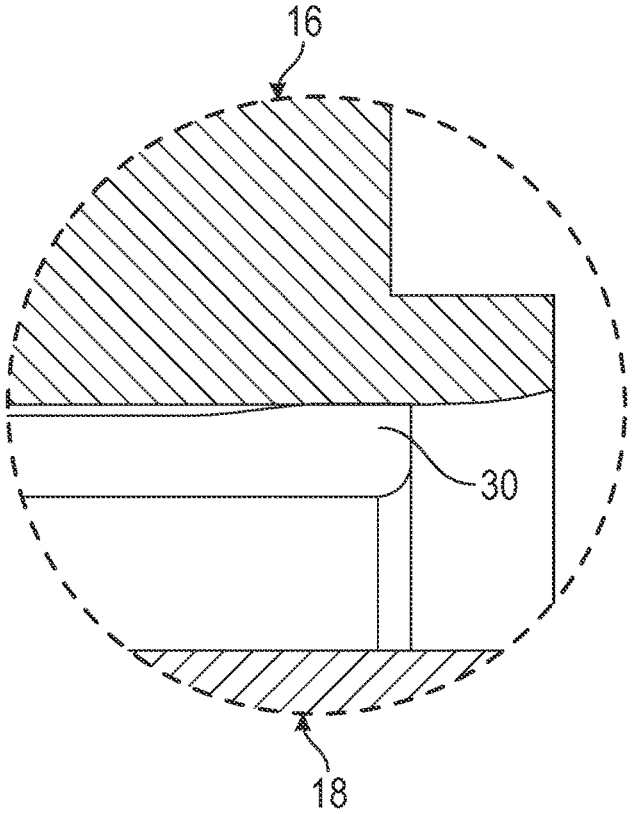
FIG. 2C is an enlarged partial view taken along circle 2C of FIG. 2A.
Figure 2D:
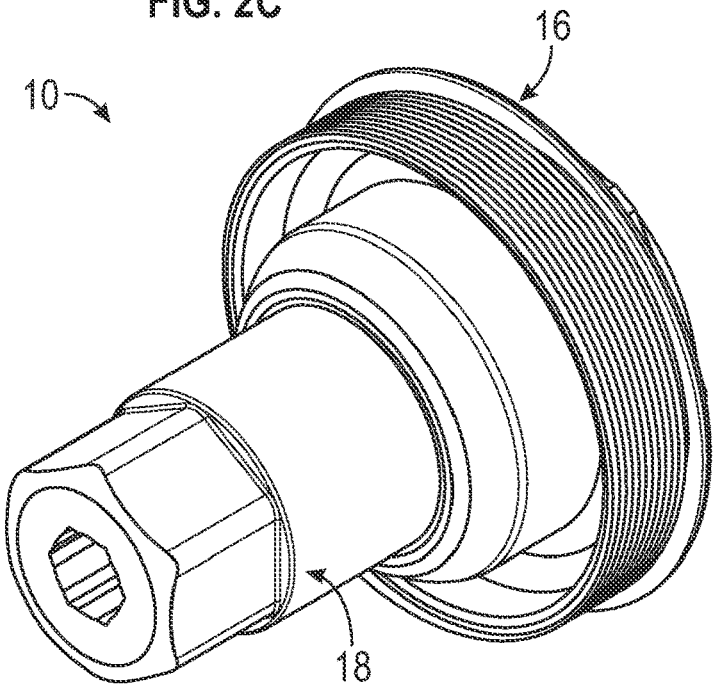
FIG. 2D is a front isometric view of the suppressor mount facility for a firearm of FIG. 1 in the assembled condition.
Figure 3A:
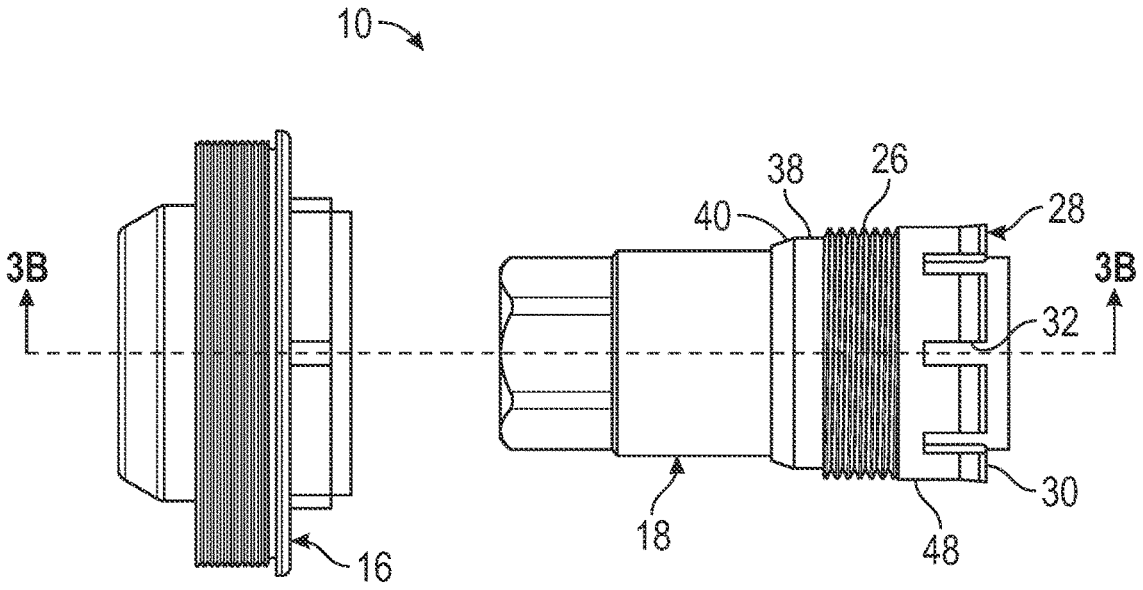
FIG. 3A is an exploded side view of the suppressor mount facility for a firearm of FIG. 1.
Figure 3B:
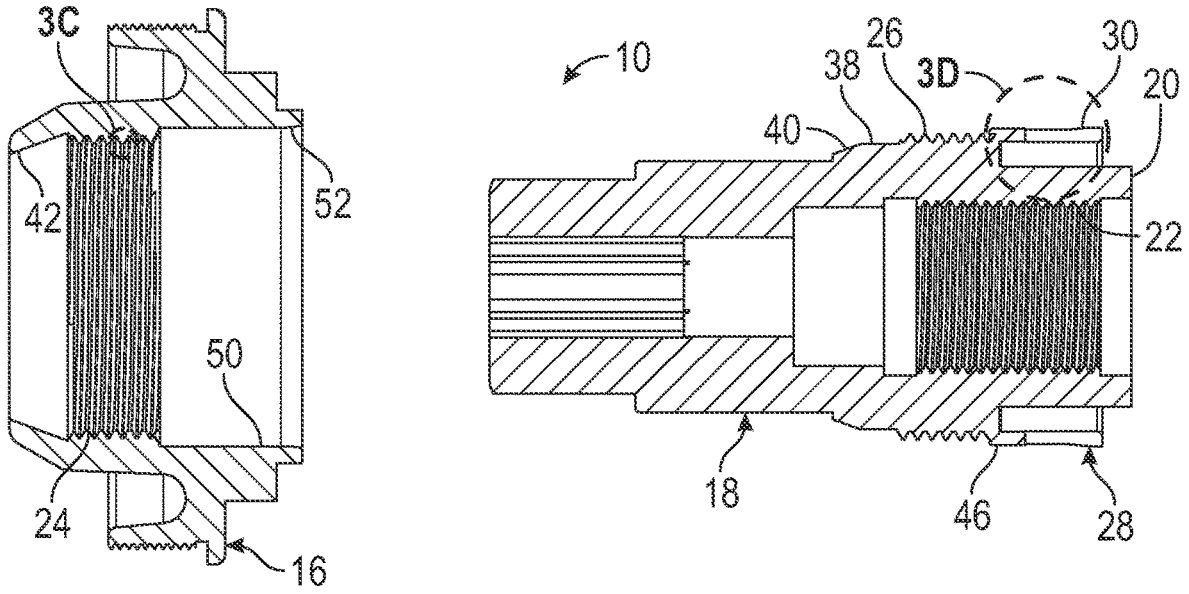
FIG. 3B is a side sectional view taken along line 3B-3B of FIG. 3A.
Figure 3C:
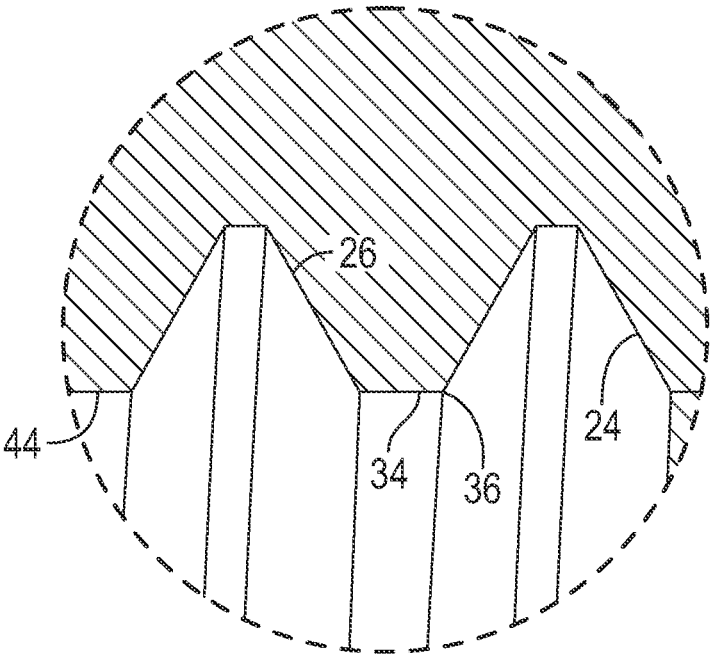
FIG. 3C is an enlarged partial view taken along circle 3C of FIG. 3B.
Figure 3D:
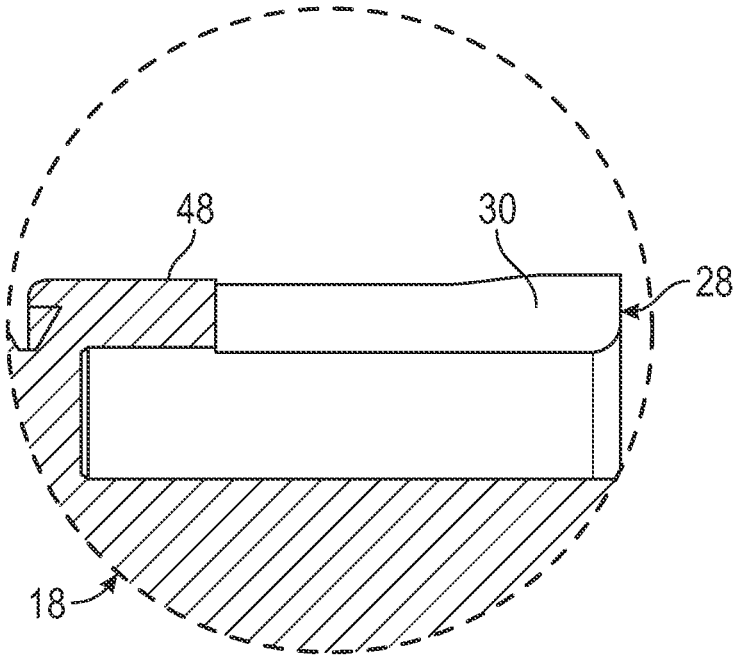
FIG. 3D is an enlarged partial view taken along circle 3D of FIG. 3B.
Figure 3E:
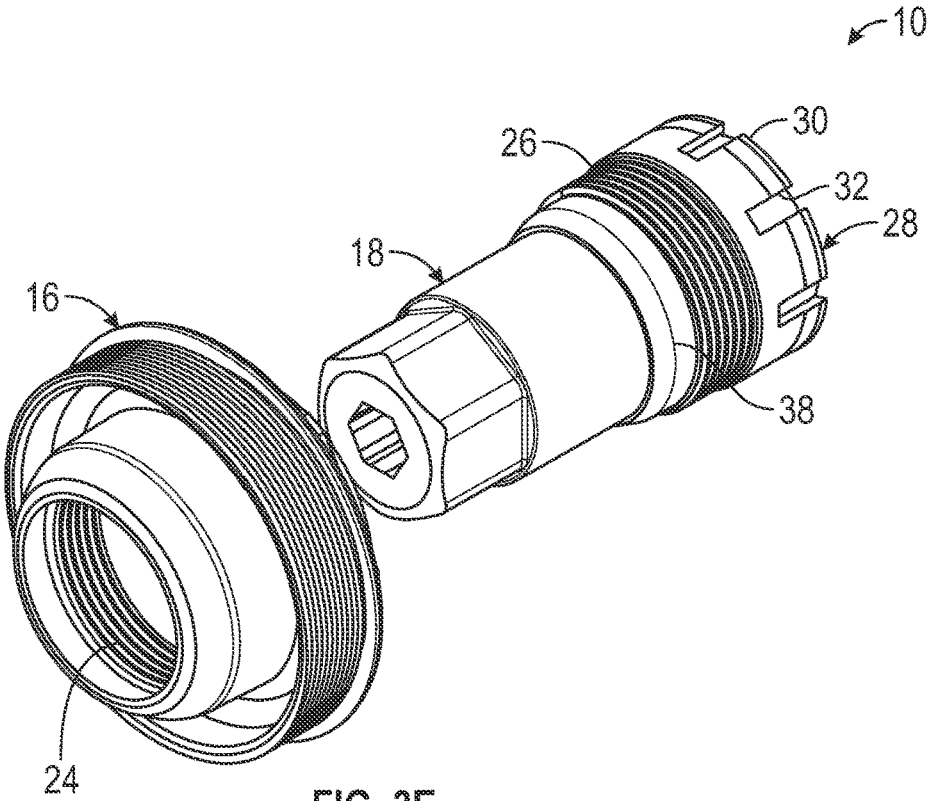
FIG. 3E is an exploded front isometric view of the suppressor mount facility for a firearm of FIG. 1.
Figure 3F:
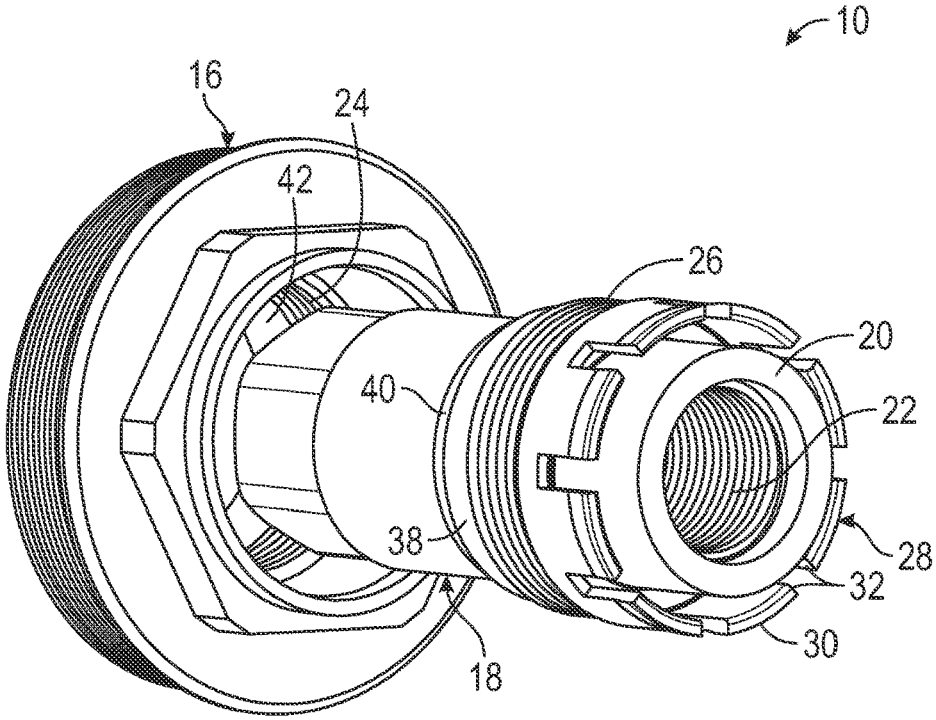
FIG. 3F is an exploded rear isometric view of the suppressor mount facility for a firearm of FIG. 1.

An embodiment of the suppressor mount facility for a firearm of the present invention is shown and generally designated by the reference numeral 10.

FIGS. 1A-3F illustrate the improved suppressor mount facility for a firearm 10 of the present invention. More particularly, FIGS. 1A-B show the suppressor mount facility for a firearm in use attaching a suppressor 12 to the barrel 14 associated with a host firearm (not shown). The suppressor mount facility has a rear cap 16 associated with the suppressor. The rear cap is attached to the suppressor using high torque and/or thread locker to ensure a secure connection. The features in the rear cap can also be included in the blast tube of the suppressor.

The suppressor mount facility 10 also has an adapter 18 having a facility for connection 20 to the barrel 14 and defining an adapter bore 22. The rear cap 16 defines an internally threaded cap bore 24. The rear cap is connected to the adapter using high torque and/or thread locker to ensure a secure connection. The adapter has an externally threaded portion 26 configured to removably connect to the internally threaded cap bore in a connected condition. The externally threaded portion is a multi-lead thread in the current embodiment. In a preferred embodiment, the externally threaded portion is a three-lead thread, resulting in more thread engagement with a reduced number of turns to enable rapid installation and disassembly using low torque applied by the user's hand. The externally threaded portion and internally threaded cap bore have tapped threads featuring lands 44 (shown in FIG. 3C). It should also be appreciated that covering the suppressor 12 with a handguard (not shown) does not interfere with operation of the suppressor mount facility.

At least one of the rear cap 16 and the adapter 18 has a flexible spring portion 28 configured to bias against the other of the rear cap and the adapter when in the connected condition. In the current embodiment, the adapter has the flexible spring portion, which includes a plurality of springs 30. The plurality of springs is a plurality of leaf springs in the current embodiment. The plurality of springs extends rearwardly from the externally threaded portion 26 of the adapter. In a preferred embodiment, the plurality of springs is a plurality of linear tabs extending rearwardly. The plurality of springs is spaced apart from each other by spring gaps 32. Each spring of the plurality of springs is a segment of a cylinder and is nearly planar except for the cylindrical curvature. The plurality of springs provides biasing when the facility for connection 20 is in a partially disconnected condition (shown in FIG. 8C). The plurality of springs flexes minimally during installation and removal and is contained within the rear cap when installed, making the plurality of springs less vulnerable to damage. The plurality of springs is the only moving part of the suppressor mount facility 10, making the suppressor mount facility more robust and easier and less costly to manufacture than prior art QD mounts.

The lands 44 of the internally threaded cap bore 24 form an alignment surface 34 at a plurality of peaks 36 of the internally threaded cap bore. In the current embodiment, the alignment surface is cylindrical. The adapter 18 has a cylindrical alignment surface 38 configured to be closely received by the alignment surface of the internally threaded cap bore. The cylindrical alignment surface is forward of the externally threaded portion 26 of the adapter. The adapter also has a rear cylindrical alignment surface 48 configured to be closely received by a rear cylindrical alignment surface 50 defined by the rear cap 16. An arcuate portion 52 is located rearward of the rear cylindrical alignment surface 50 to guide insertion of the adapter. The rear cylindrical alignment surface 48 is rearward of the externally threaded portion 26 of the adapter. The rear cylindrical alignment surface 50 is rearward of the internally threaded cap bore of the rear cap. The adapter has a tapered nose 40, and the rear cap 16 has an internally tapered shoulder 42 configured to be abutted by the tapered nose when in the connected condition. The interaction between the alignment surface and cylindrical alignment surface, the interaction between the two rear cylindrical alignment surfaces, and the interaction between the tapered nose and internally tapered shoulder provide self-centering to enable quick and assured thread alignment during assembly and provides a taper lock (shown in FIG. 2B) to initially secure the rear cap to the adapter. The plurality of springs 30 has an outer diameter larger than the remainder of the adapter. Thus, when engaged with the rear cap, the plurality of springs is compressed to create tension between the rear cap and the adapter to further secure the rear cap to the adapter. Should the taper lock fail to hold and release when subjected to heat cycles, vibration, or failure to fully manually tighten the rear cap onto the adapter, the spring tension prevents the adapter from unthreading from the rear cap. The spring tension also keeps the adapter centered within the rear cap, which keeps the suppressor 12 from dropping into the path of a bullet and causing bullet strikes on the baffles 46 within the suppressor.

Figure 4:
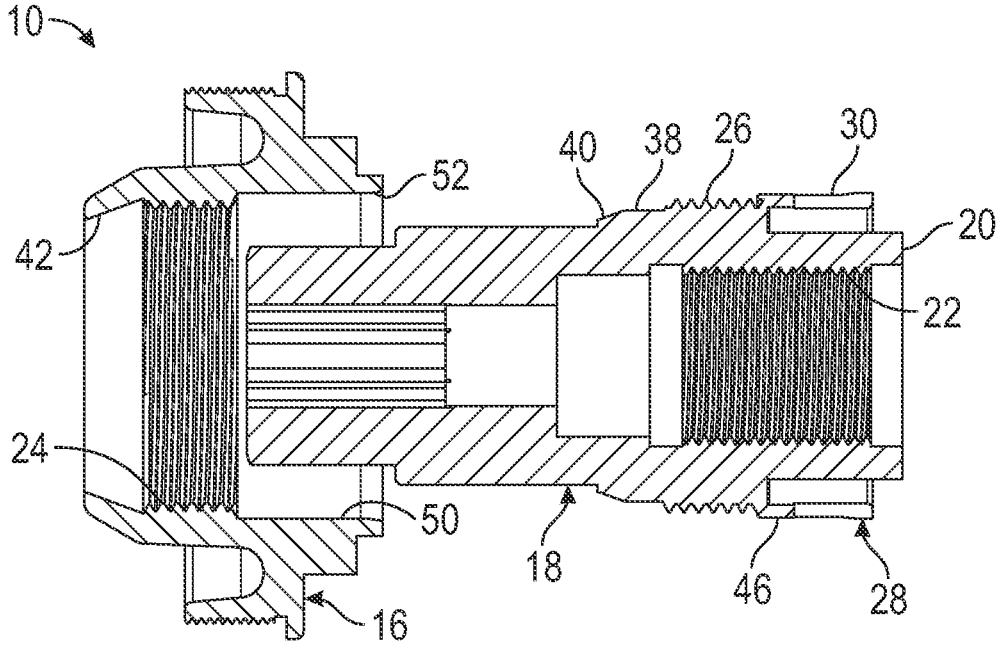
FIG. 4 is a side sectional view of the suppressor mount facility for a firearm of FIG. 1 at the point of initial insertion of the adapter into the rear cap.

FIG. 4 illustrates the improved suppressor mount facility for a firearm 10 of the present invention. More particularly, the suppressor mount facility is shown at the point of initial insertion of the adapter 18 into the rear cap 16. The adapter and rear cap have not yet made any contact with one another.

Figure 5A:
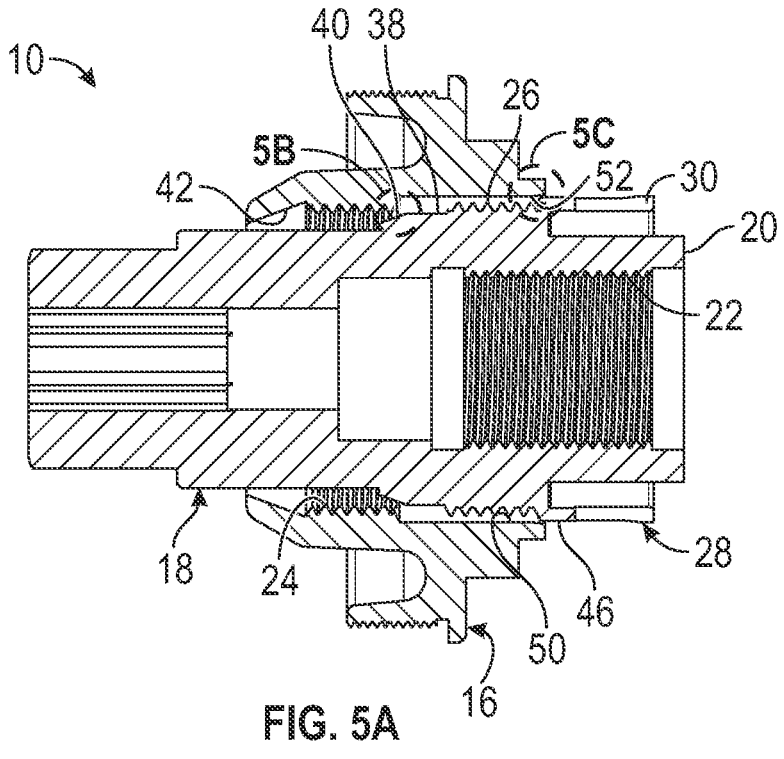
FIG. 5A is a side sectional view of the suppressor mount facility for a firearm of FIG. 1 at the point of pre location of the adapter within the rear cap.
Figure 5B:
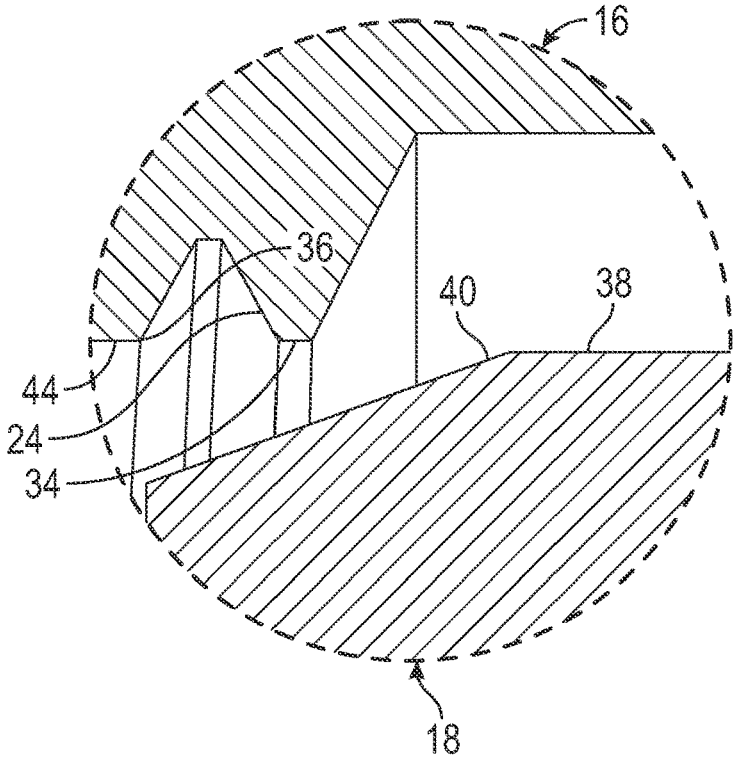
FIG. 5B is an enlarged partial view taken along circle 5B of FIG. 5A.
Figure 5C:
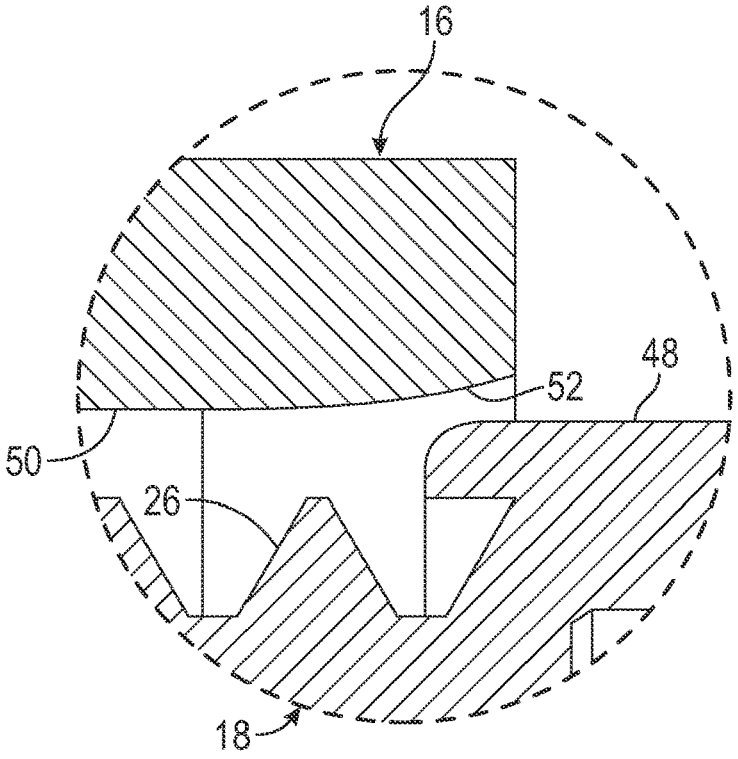
FIG. 5C is an enlarged partial view taken along circle 5C of FIG. 5A.

FIGS. 5A-C illustrate the improved suppressor mount facility for a firearm 10 of the present invention. More particularly, the suppressor mount facility is shown at the point of pre location of the adapter 18 within the rear cap 16. The adapter and rear cap have still not made any contact between one another.

Figure 6A:
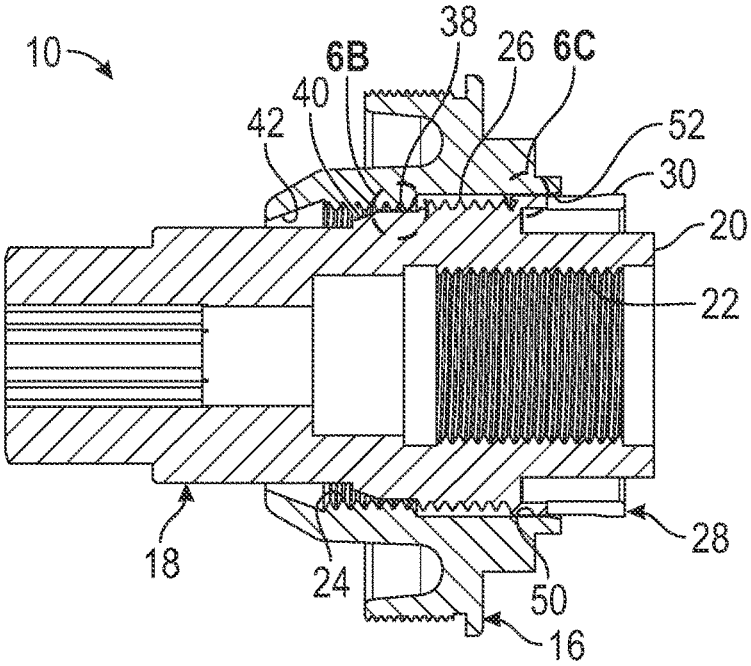
FIG. 6A is a side sectional view of the suppressor mount facility for a firearm of FIG. 1 at the point of location of the cylindrical alignment surface of the adapter with the alignment surface of the internally threaded cap bore of the rear cap and the rear cylindrical alignment surface of the adapter with the rear cylindrical alignment surface defined by the rear cap.
Figure 6B:
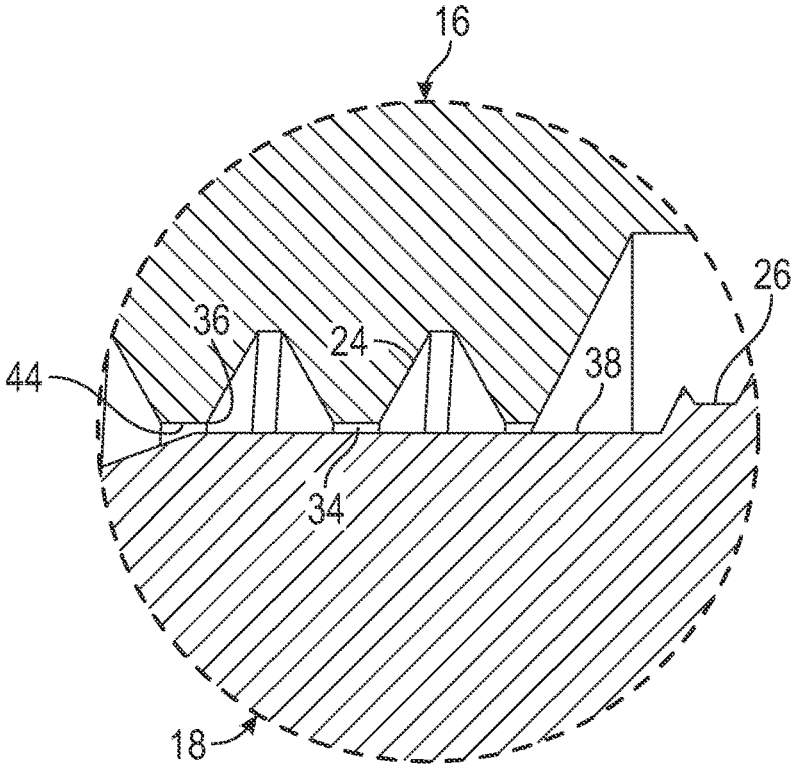
FIG. 6B is an enlarged partial view taken along circle 6B of FIG. 6A.
Figure 6C:
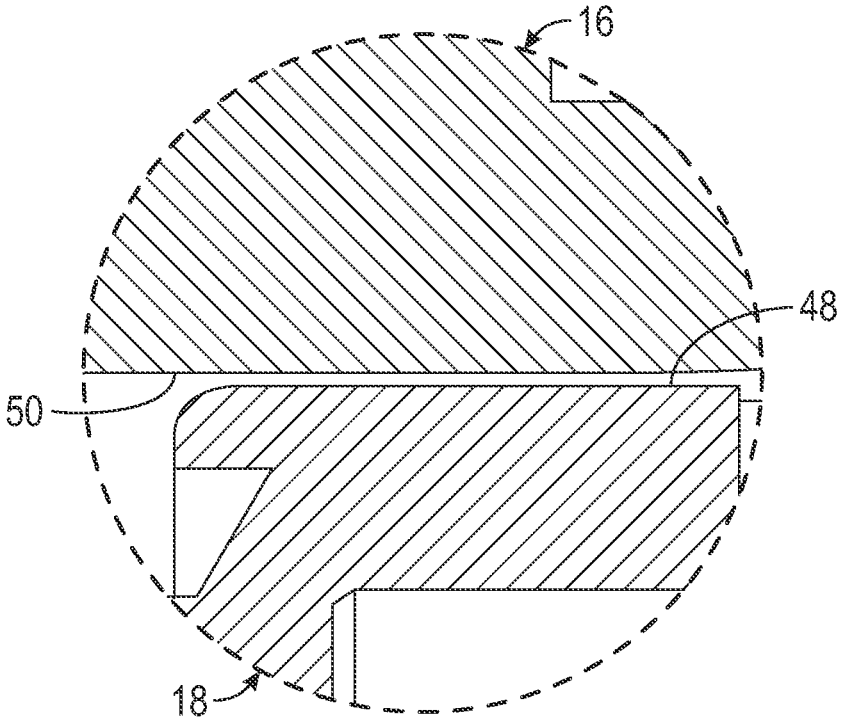
FIG. 6C is an enlarged partial view taken along circle 6C of FIG. 6A.
Figure 7A:
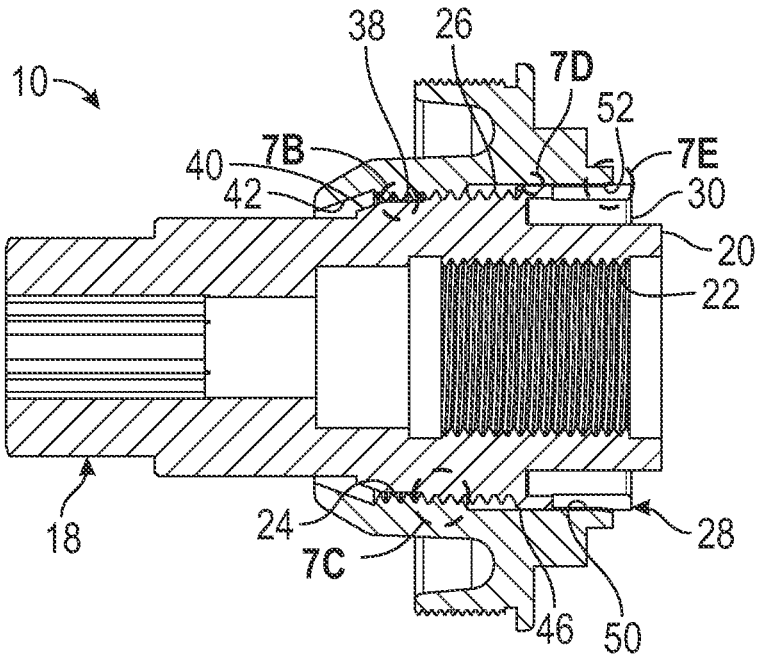
FIG. 7A is a side sectional view of the suppressor mount facility for a firearm of FIG. 1 at the point of pre tension of the springs with the externally threaded portion of the adapter engaged with the internally threaded cap bore of the rear cap.
Figure 7B:
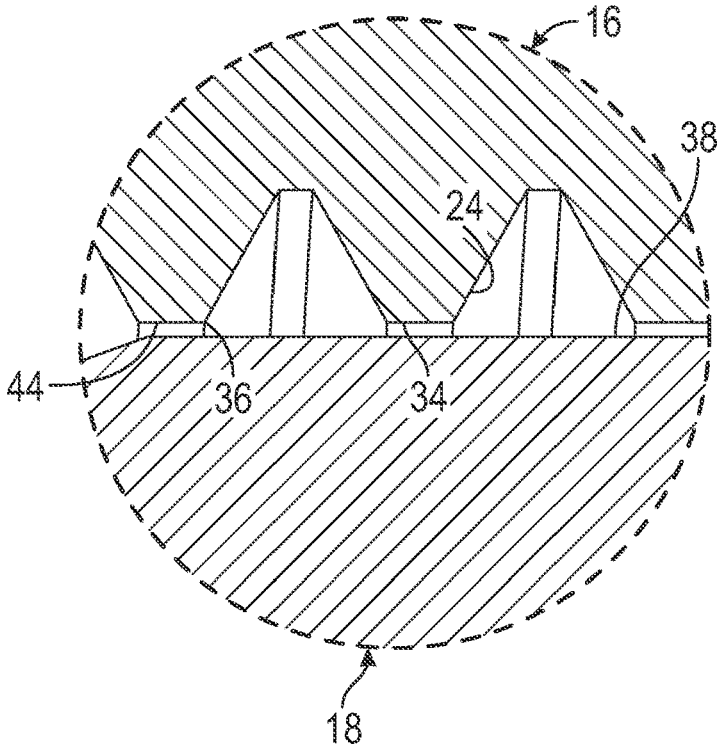
FIG. 7B is an enlarged partial view taken along circle 7B of FIG. 7A.
Figure 7C:
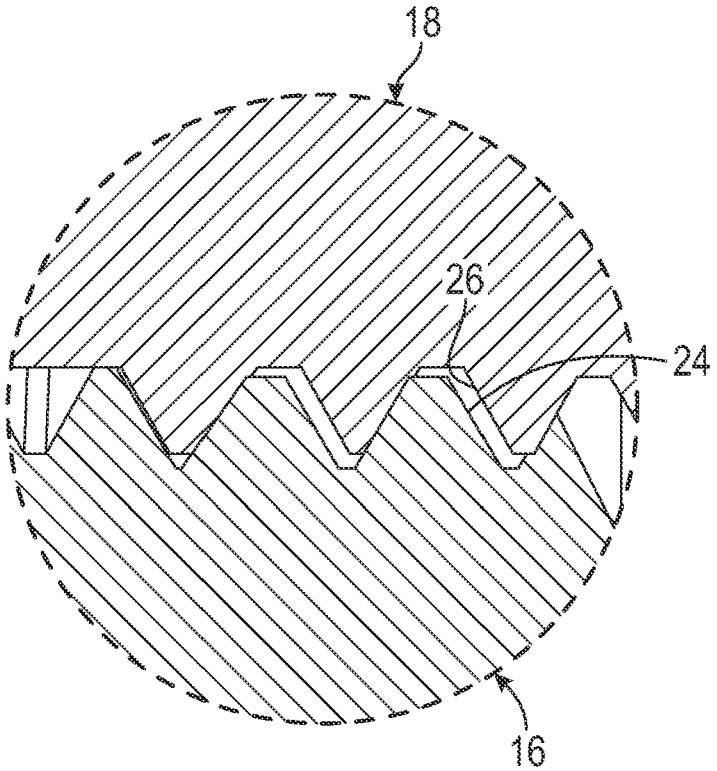
FIG. 7C is an enlarged partial view taken along circle 7C of FIG. 7A.
Figure 7D:
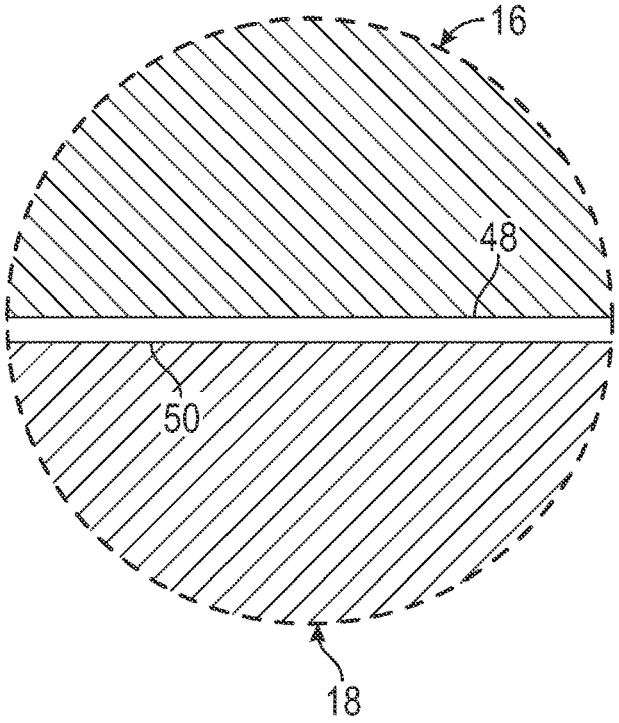
FIG. 7D is an enlarged partial view taken along circle 7D of FIG. 7A.
Figure 7E:
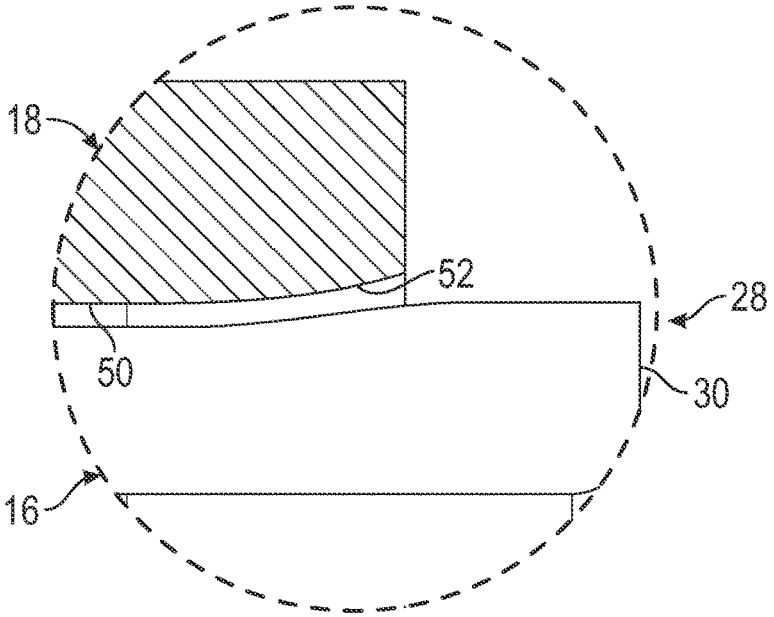
FIG. 7E is an enlarged partial view taken along circle 7E of FIG. 7A.

FIGS. 6A-C illustrate the improved suppressor mount facility for a firearm 10 of the present invention. More particularly, the suppressor mount facility is shown at the point of location of the cylindrical alignment surface 38 of the adapter 18 with the alignment surface 34 of the internally threaded cap bore 24 of the rear cap 16 and the rear cylindrical alignment surface 48 of the adapter with the rear cylindrical alignment surface 50 defined by the rear cap.

FIGS. 7A-E illustrate the improved suppressor mount facility for a firearm 10 of the present invention. More particularly, the suppressor mount facility is shown at the point of pre tension of the springs 30 with the externally threaded portion 26 of the adapter 18 engaged with the internally threaded cap bore 24 of the rear cap 16.

Figure 8A:
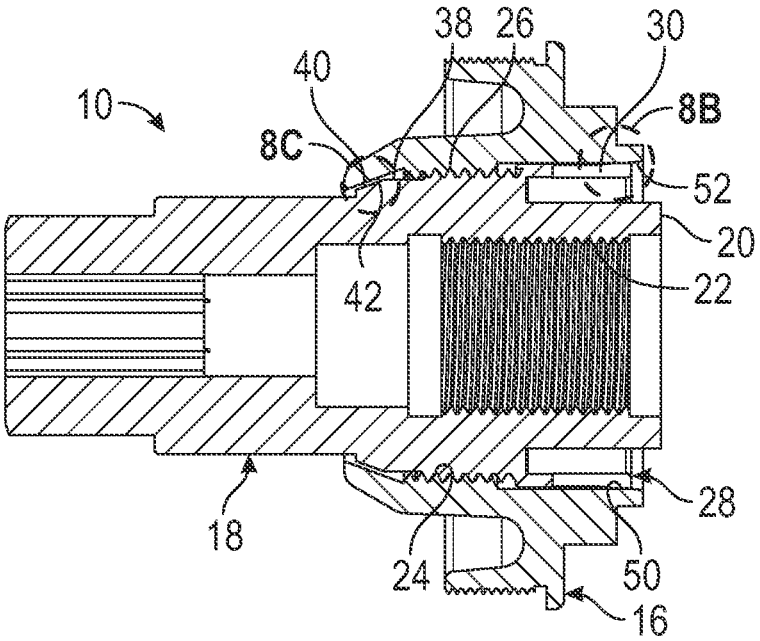
FIG. 8A is a side sectional view of the suppressor mount facility for a firearm of FIG. 1 at the point of tension of the springs with the tapered nose and internally tapered shoulder not yet establishing a taper lock.
Figure 8B:
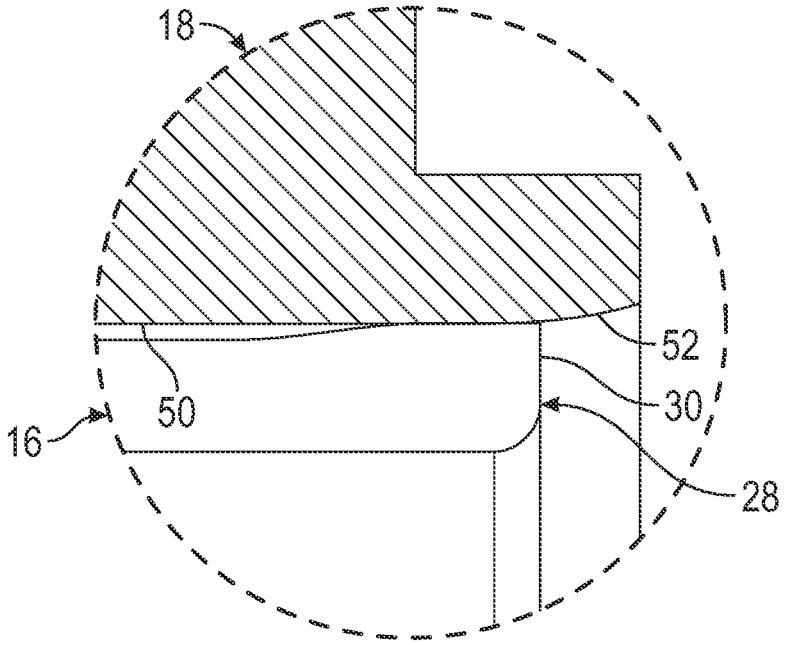
FIG. 8B is an enlarged partial view taken along circle 8B of FIG. 8A.
Figure 8C:
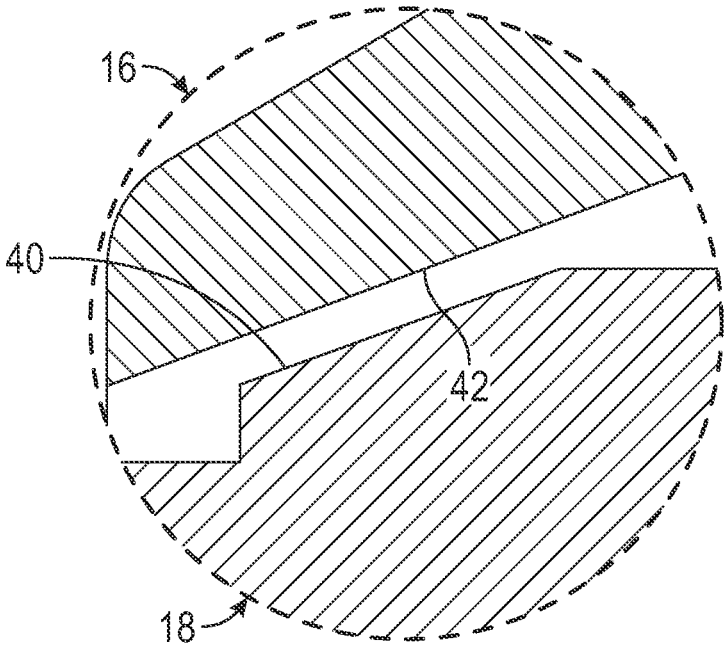
FIG. 8C is an enlarged partial view taken along circle 8C of FIG. 8A.

FIGS. 8A-C illustrate the improved suppressor mount facility for a firearm 10 of the present invention. More particularly, the suppressor mount facility is shown at the point of tension of the springs 30 with the tapered nose 40 of the adapter 18 and internally tapered shoulder 42 of the rear cap 16 not yet establishing a taper lock. The tension of the springs established at this stage of the assembly process prevents unintentional additional loosening that would subject the baffles 46 within the suppressor 12 to bullet strikes. Further torquing of the adapter into the rear cap results in the assembled condition of the suppressor mount facility and creates the taper lock shown in FIG. 2B.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a suppressor mount facility for a firearm has been described in detail, it should be apparent that modifications and variations thereto are possible, all of which fall within the true spirit and scope of the invention. Although suppressors have been disclosed, the suppressor mount facility for a firearm is also suitable for use with other muzzle devices such as blast diverters, flash hiders, muzzle brakes, and compensators. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suppressor mount facility for a firearm comprising:

a rear cap associated with a suppressor;

an adapter having a facility for connection to a barrel associated with the firearm, the adapter defining an adapter bore;

the rear cap defining an internally threaded cap bore;

the adapter having an externally threaded portion configured to removably connect to the internally threaded cap bore in a connected condition;

at least one of the rear cap and the adapter having a flexible spring portion that includes a plurality of springs that extend rearwardly from the externally threaded portion of the adapter, the plurality of springs being configured to flex radially outwardly when the rear cap and the adapter are threaded together so as to continuously bias against the at least one of the rear cap and the adapter.

2. The suppressor mount facility of claim 1 wherein the plurality of springs is arranged circumferentially about the adapter bore.

3. The suppressor mount facility of claim 1 wherein the plurality of springs is a plurality of leaf springs.

4. The suppressor mount facility of claim 1 wherein the plurality of springs is a plurality of linear tabs extending rearwardly.

5. The suppressor mount facility of claim 4 wherein the plurality of springs is spaced apart from each other by spring gaps.

6. The suppressor mount facility of claim 1 wherein each of the plurality of springs is a segment of a cylinder.

7. The suppressor mount facility of claim 1 wherein the plurality of springs provides biasing when the facility for connection is in a partially disconnected condition.

8. The suppressor mount facility of claim 1 wherein the internally threaded cap bore includes an alignment surface at a plurality of peaks of the internally threaded cap bore.

9. The suppressor mount facility of claim 8 wherein the alignment surface is cylindrical.

10. The suppressor mount facility of claim 9 including a cylindrical alignment surface of the adapter configured to be closely received by the alignment surface of the internally threaded cap bore.

11. The suppressor mount facility of claim 10 wherein the cylindrical alignment surface is forward of the externally threaded portion of the adapter.

12. The suppressor mount facility of claim 1 wherein the adapter has a tapered nose, and the rear cap has an internally tapered shoulder configured to be abutted by the tapered nose when in the connected condition.

13. The suppressor mount facility of claim 1 wherein the externally threaded portion is a multi-lead thread.

14. The suppressor mount facility of claim 13 wherein the externally threaded portion is a three-lead thread that is configured to facilitate thread engagement with a reduced number of turns.

15. A suppressor mount facility for a firearm comprising:

a rear cap associated with a suppressor;

an adapter having a facility for connection to a barrel associated with the firearm, the adapter defining an adapter bore;

the rear cap defining an internally threaded cap bore;

the adapter having an externally threaded portion configured to removably connect to the internally threaded cap bore in a connected condition; and wherein the adapter has a flexible spring portion that includes a plurality of springs configured to flex radially outwardly so as to bias against the rear cap when the rear cap and adapter are threadably connected together.

16. The suppressor mount facility for a firearm as in claim 15 wherein the externally threaded portion is a three-lead thread that is configured so as to cause thread engagement with a reduced number of turns.

* * * * *